US006956157B2

(12) United States Patent
Strobel

(10) Patent No.: US 6,956,157 B2
(45) Date of Patent: Oct. 18, 2005

(54) PORTABLE TRAVEL GUITAR

(76) Inventor: Russell Strobel, 18211 104th Ter., Boca Raton, FL (US) 33498

( * ) Notice: Subject to any disclaimer, the term of this patent is extended or adjusted under 35 U.S.C. 154(b) by 138 days.

(21) Appl. No.: 10/393,961

(22) Filed: Mar. 22, 2003

(65) Prior Publication Data

US 2004/0182220 A1 Sep. 23, 2004

(51) Int. Cl.[7] ..... G10D 3/04
(52) U.S. Cl. ..... 84/298
(58) Field of Search ..... 84/298, 267, 280, 84/281, 290, 303, 297 R

(56) References Cited

U.S. PATENT DOCUMENTS 4,191,085 A 3/1980 Litwin
4,939,970 A 7/1990 Hoshino
5,353,672 A 10/1994 Stewart
5,949,005 A * 9/1999 Peterson ..... 84/291
6,025,548 A * 2/2000 Ehrlich ..... 84/291

* cited by examiner

*Primary Examiner*—Kimberly Lockett

(57) ABSTRACT

A portable travel guitar that can be quickly disassembled to fit in a business briefcase. A string keeper disengages from the end of the neck and maintains the strings in order when disassembled. This feature allows the neck to be separated from the body for compact storage when disassembled. The body includes string storage flanges for stowing the strings that are wound around the storage flanges. The portable travel guitar is assembled by unwrapping the strings from the storage flanges, setting the neck in place, and attaching to the body with bolts and wing nuts. The string keeper is set into place at the top of the neck and attached with thumbscrews or other appropriate attachment method. The guitar is then tuned as normal. The assembly and/or disassembly process takes about five minutes and requires no tools.

19 Claims, 4 Drawing Sheets

PORTABLE TRAVEL GUITAR

FIELD OF THE INVENTION

This invention relates in general to a guitar and more particularly to a portable guitar.

BACKGROUND OF THE INVENTION

There is a long history of stringed instruments with roots back to the Spanish guitar developed around the first millennium. Through the centuries designers have experimented with various materials, shapes, number of strings, and the size of the instrument. A common denominator has been a plurality of strings, a neck, and a body.

It has long been recognized that any guitar, with a joined neck and body is hard to transport. Therefore, this invention solves the portability problem associated with transporting a standard scale length guitar.

Several fold away and detachable neck guitars have been described in the prior art. Most of these units are specified to have a mechanism to collect the neck to the body while disassembled. In these designs, the strings remain attached to the top of the neck after the neck is separated from the body. This linkage between the neck and body through the strings requires more storage space than the present invention.

This drawback is demonstrated in Litwin, U.S. Pat. No. 4,191,085. Litwin's invention keeps the strings connected between the neck and body when the unit is disassembled. This severely limits the portability of the unit. He has also expressed that the neck be tucked away into a standard size acoustic guitar body. Thus, Litwin's invention could never be smaller than the body of an acoustic guitar.

Some of the prior art suggests that the guitar could be taken apart and re assembled without re tuning. It would be dangerous to try and disengage the neck of a guitar tuned to concert pitch without de tuning the instrument. Upon release the neck would fly away from the body due to the string tension. It is most certainly guaranteed that a guitar utilizing this idea would require tuning upon assembly.

This impractical system (without releasing string tension) is a key claim of Stewart, U.S. Pat. No. 5,353,672. Stewart describes a quick release neck clamp that is easily removed without de-tuning the strings. Any one skilled in the art would be extremely reluctant to quickly disengage a neck from a guitar with the strings under full tension. Stewart also expects that the strings would stay attached between the neck and the body when the guitar is taken apart. This necessarily would take more storage space than the current invention, due to the need to keep the neck in close proximity to the body.

SUMMARY OF THE INVENTION

Briefly, according to the invention, there is provided a travel guitar. The small size and portability of the present invention allows a traveling musician an apparatus to conveniently carry with them when traveling. It is particularly appropriate for the traveling executive, normally limited to two carry on items on any trip requiring travel by air. This invention can be stowed in the traveler's briefcase along with the normal business files required on the trip. As the instrument is electric, it makes little sound during playing, and could even be assembled and played during a trip on an airplane.

A principal object of the present invention is to provide a practical travel guitar that can easily be stowed in a standard business briefcase. The instrument plays and sounds like a standard size instrument. The small body may be 13" to 15" (33–38 cm) long (depending on tuning key configuration), from 7" to 8" (18–20 cm) wide and less than 1½" (3.8 cm) thick. The neck has 20 to 22 standard spaced frets and is from 17" to 19" (43–48 cm) long (depending on number of frets used). The neck length is reduced due to mounting the tuning keys on the body. The removable neck can be easily disassembled, separated from the body and stowed in a standard briefcase. Four simple wing nuts attach the neck to the body (in the present embodiment).

Another object of the invention is to provide a means to keep the strings in order while the unit is disassembled. A string keeper is employed at the top of the neck. The string keeper is detached from the neck when the guitar is taken apart. The ball end of the strings rest in the holes in the string keeper.

Another object of the invention is to provide string retention flanges (or holding screws) on the body of the instrument to hold the strings when the guitar is traveling. This allows the neck to be completely detached from the body and facilitates compact storage for traveling.

Another object of the invention is the unique string spreader employed between the bridge and the tuning keys. The string spreader minimizes the stress on the strings by channeling the strings towards the appropriate tuning peg. The routing of the strings from the bridge to the tuning keys is facilitated by the angles of the string channels in the string spreader. This approach minimizes string breakage. The string spreader insures the strings remain firmly seated on the bridge.

Another object of the invention is to minimize manufacturing cost by using standard widely available components. A standard guitar neck is used without the tuning pegs or a headstock. A standard Tun-O-matic type bridge is used.

Another object of the invention is to provide a travel guitar that can be easily and quickly assembled with no tools.

Another object of the invention is to provide a removable neck system with no special clamps, plates or hooks required to attach the neck to the body.

A further object of the invention integrates the neck bolts as an integral part of the removable neck. The bolts would be part of the neck, with the fingerboard covering the heads of the bolts. Most bolt on necks use screws installed from the body side into the neck.

A further object of the invention is the ergonomically designed tuning key mounting system. Offsetting the centerline of the interior keys to enhance the tuning process creates this system. This also facilitates tuning peg location.

A further object of the invention is a unique arrangement of the tuning keys to minimize the length and width of the guitar body.

DESCRIPTION OF A PREFERRED EMBODIMENTS

Figure 1:
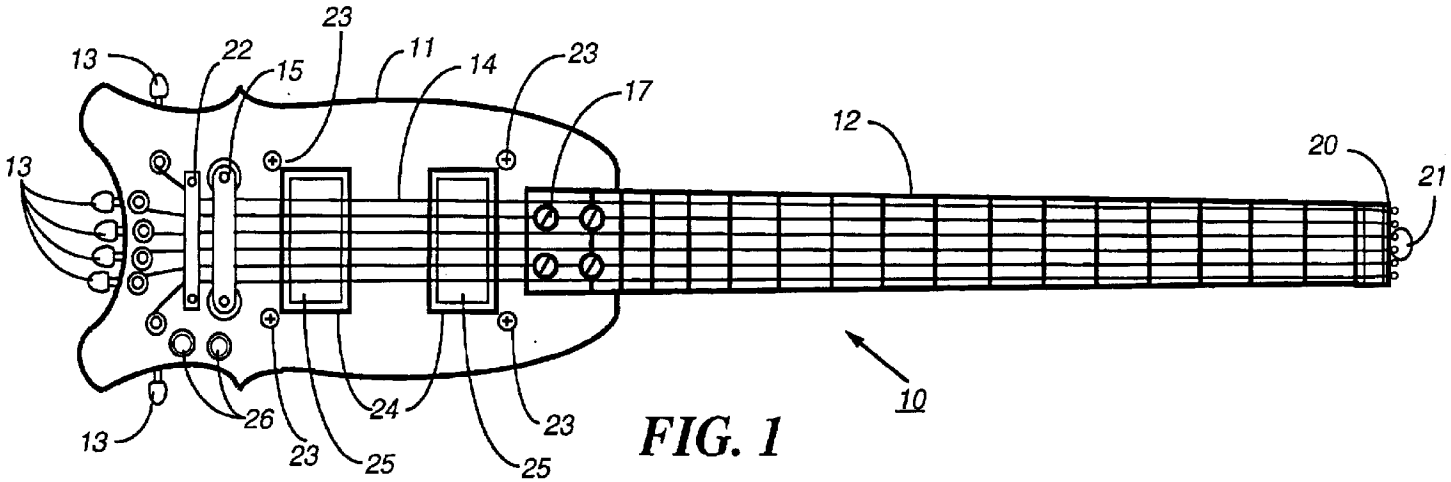
FIG. 1 is a top plan view of a guitar in the assembled state according to a preferred embodiment of the present invention.

The instrument is fabricated from the finest sonic materials and expert lutherie processes. Guitar tone being the key objective of a well crafted instrument. When plugged into an amplifier the guitar will provide exceptional tone and playability. When traveling, the musician will plug the travel guitar into a portable headphone amplifier should he or she desire to take advantage of the electronic tones and sustain available from the guitar.

It appears that a standard size body (either acoustic or electric style) is called for in the prior art. Some of the prior art suggests it would not be necessary to re-tune the instrument after assembly. It is however essential that retuning would be required due to the exacting relationships between string tension and pitch. In addition, most guitarists tune their instruments before playing even a standard guitar that has not been disassembled. The present invention allows the neck to be totally separated from the body to facilitate compact transportation. In particular, this travel guitar fits in a standard business briefcase when disassembled. The neck and strings can be re-attached to the body with no special tools.

Travel type guitars are available which are scaled down versions of a standard guitar. Some of these units suffer from a short scale length and are not easily tuned to normal pitch (A440). None of these would fit conveniently in a briefcase for traveling. The present invention uses a full-scale length (typically 24⅝" [62 cm] from bridge to nut). Most of the current commercially available travel guitars have the neck permanently attached to the body. The present invention is intended to be an electric type guitar, thereby minimizing the size of the guitar body.

The other collapsible or fold away guitars expect that the strings stay attached to the top of the neck when disassembled. Some even claim to be able to re-attach the neck keeping string tension normal. Given the stresses induced by the tension of the strings when tuned to A440, this is very unlikely, and certainly unsafe. The other disadvantage of this approach is that the neck must remain in close proximity to the body of the guitar when disassembled.

In the current invention, the process for disassembly allows the strings to be loosened so the string keeper can be safely removed from the top of the neck. Two thumbscrews (reference FIGS. 5A through 5D) are loosened to allow removal of the string keeper. Alternate embodiments may employ one or no thumbscrews (reference FIGS. 5E through 5H). The screwless embodiments may use a positive locating retainer that securely attaches the string keeper to the neck while maintaining correct string alignment and tension. The string keeper can then be slipped away from the top of the neck with the strings still attached via the holes in the string keeper. For a typical guitar, there are six holes in the string keeper, but as one of ordinary skill in the art will appreciate, there may be as few as four, or as many as 12 holes corresponding to the number of strings. The strings are then wrapped around the string retention flanges attached to the body. These flanges could be integral with the plastic rings used to mount the electric pick-ups on the guitar or may be stand alone retention flanges. After the strings are stowed, the neck is removed from the body by loosening four wing nuts (or equivalent simple fastening system). Other neck attachment methods could also be used such as a tongue and lap joint.

To reassemble the guitar, the neck is attached to the body with a standard four-bolt system and four wing nuts. The strings are unwrapped from the flanges with the string keeper. The string keeper is reinserted and attached to the top of the neck with the thumbscrew(s) or flange pins. No tools are required for assembly or disassembly of the guitar. After assembly, the guitar is tuned as normal. Use of the single quick release thumbscrew would minimize the retuning effort.

The preferred embodiment of the current invention uses standard tuning keys, standard single ball strings, and a standard tun-o-matic bridge. Other standard items include the pick-ups, volume and tone circuits, and jack.

FIG. 1 shows the top view of a preferred embodiment as it relates to an electric guitar 10. The basic components of the guitar are the body 11 and the neck 12. The tuning pegs 13 are located on tail of the body 11 (instead of at the end of the neck) to minimize the length of the neck 12. The neck 12 is a standard 20 to 22-fret neck with standard fret spacing to accommodate a standard string scale length. The strings 14 are stretched from the string keeper 20, along the neck, over the body 11 containing the pick-ups 25, to the bridge 15, through the string spreader 22 and on to the tuning pegs 13. The instrument uses standard single ball end strings, with the ball end captured by the string keeper 20. The other end of the string is passed through a hole or slot in the tuning pegs 13. The tuning pegs are rotated to achieve the desired tension on the strings 14.

Figure 2:
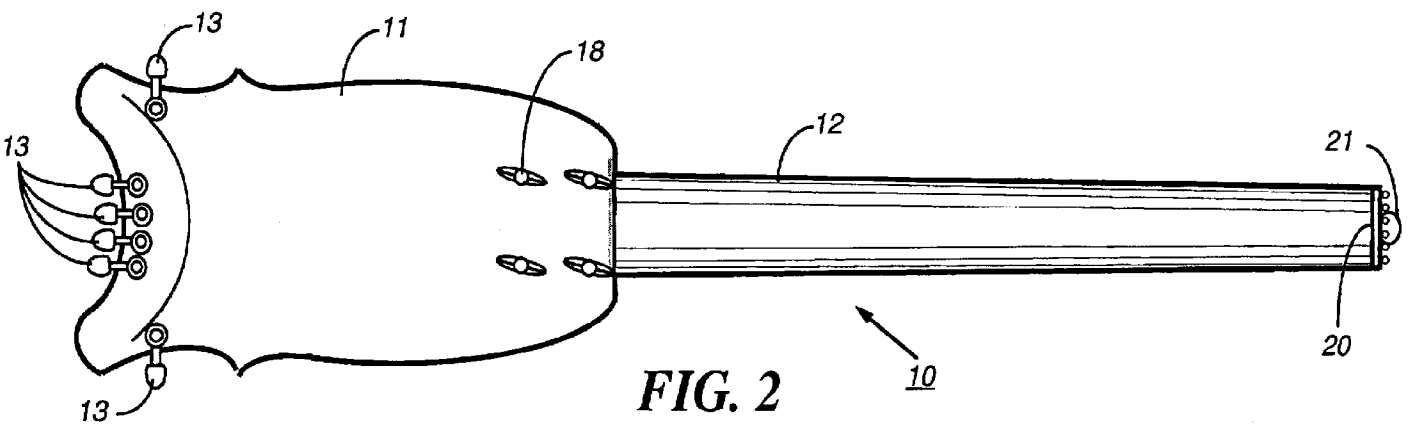
FIG. 2 is a bottom plan view of a guitar in the assembled state according to a preferred embodiment of the present invention.

FIG. 2 illustrates a back view of the travel guitar. Quick release wing nuts 18 are used to attach the removable neck 12 to the body 11. Also noted in this drawing is the arrangement of the tuning keys 13. After releasing the string tension using the quick release thumbscrew 21, the string keeper 20 is removed from the top of the neck 12. The strings 14 are held in relative position by the string keeper 20. Now the wing nuts 18 can be loosened allowing the neck 12 to be disengaged from the body 11.

Figure 3:
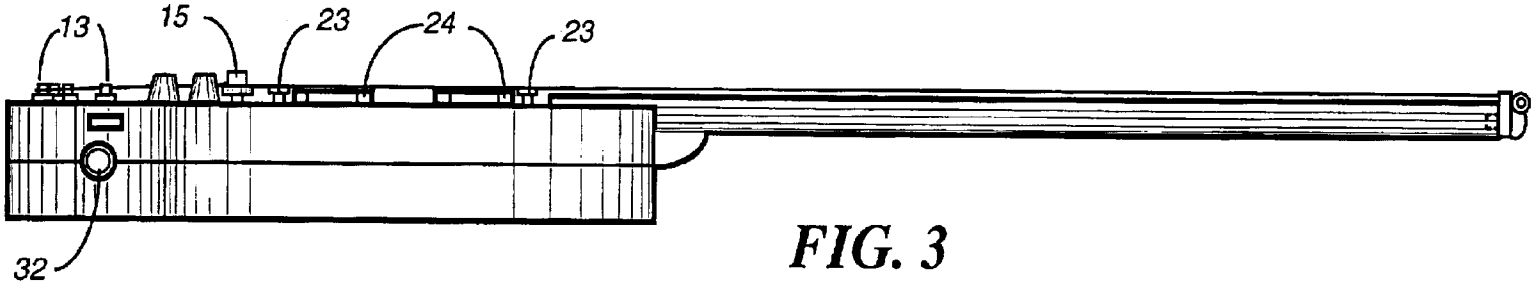
FIG. 3 is a side elevation of a guitar in the assembled state according to a preferred embodiment of the present invention.

FIG. 3 is a side elevation of the travel guitar 10 in it's assembled state. The strings 14 are stretched from the string keeper 20, along the neck 12, over the body 11 containing the pick-ups 25, over the bridge 15, through the string spreader 22 and on to the tuning pegs 13. The string flanges 23 are used to store the strings 14 as described in reference to FIG. 4. Also shown is a jack 32.

Figure 4:
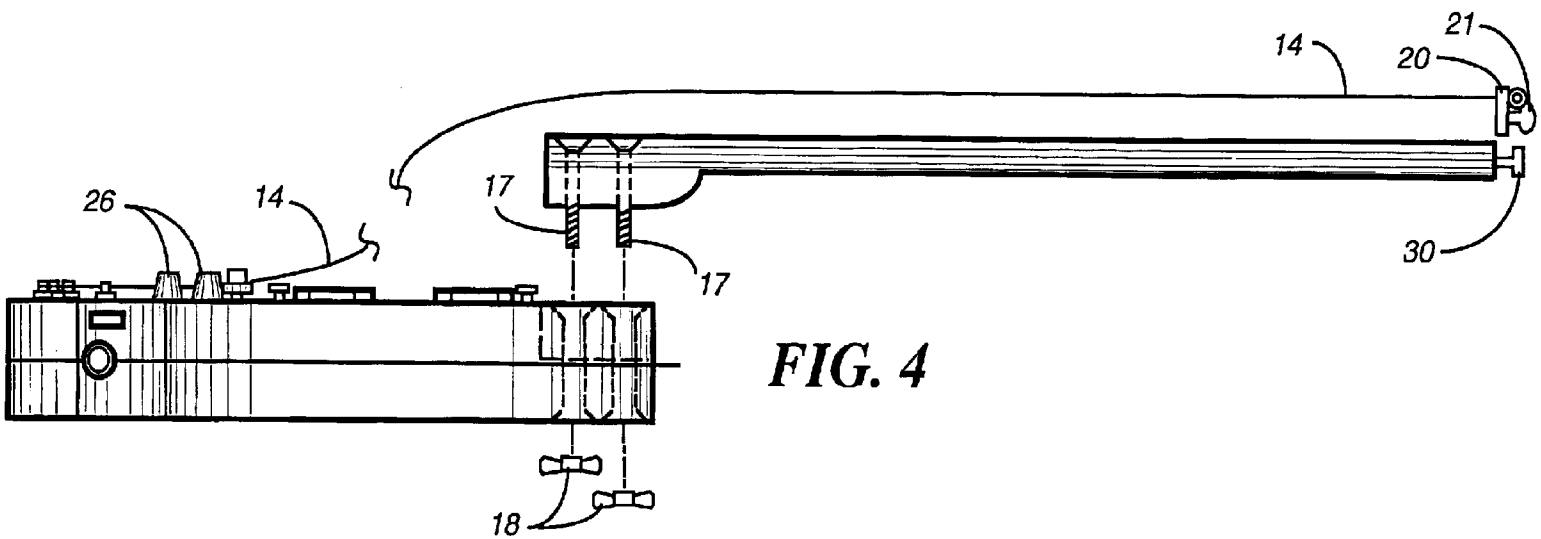
FIG. 4 is a side elevation of a guitar in the disassembled state according to a preferred embodiment of the present invention, showing the neck removed and the strings retained in order by the string keeper.

FIG. 4 shows a side elevation of the guitar 10 with the neck 12 removed. The quick release thumbscrew 21 has been loosened and the strings 14 are now ready to be stowed with the body 11 using the string retention flanges 23. The strings 14 are wound around the string retention flanges 23, while being held in relative order by the string keeper 20. The pick up rings 24 are used to hold the pick ups 25 in place in the body 11. The quick release thumbscrew 21 is captured by the string keeper 20 for storage. In this state, the guitar consists of two free standing main components, the removable neck 12 and the body 11 with the strings 14 stowable using the string retention flanges 23 and the string keeper 20. These two components are now ready for inclusion in a standard business briefcase (or the like) for traveling. Now that the neck 12 is disengaged from the body 11, the traveler has much more flexibility to stow the component parts.

Figure 5A:
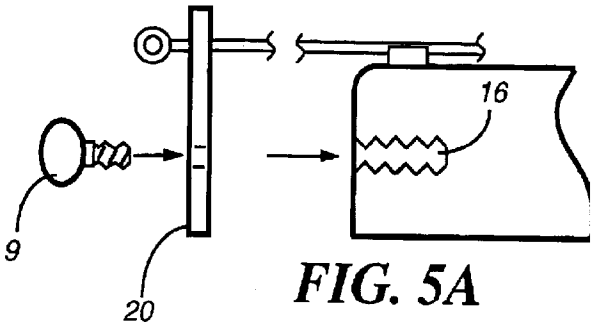
FIG. 5A is a cut away side view of the top of the neck showing a threaded insert used to capture the small thumbscrews.

FIGS. 5A–5H detail several embodiments of the string keeper 20 and associated attachment methods. FIG. 5A is a cut away side view of the top of the neck showing a threaded insert 16 used to capture two small thumbscrews 19. The small thumbscrews 19 are used to attach the removable string keeper to the neck. The strings 14 pass through holes 27 in the string keeper 20 that holds the ball end of the strings 14 in place. The small thumbscrews 19 are reinserted in the threaded inserts 16 for storage. The string keeper 20 is removed from the neck 12 along with the strings 14. This assembly is then stowed with the body 11 using the string retention flanges 23. The strings are connected at the other end to the tuning pegs 13.

Figure 5B:
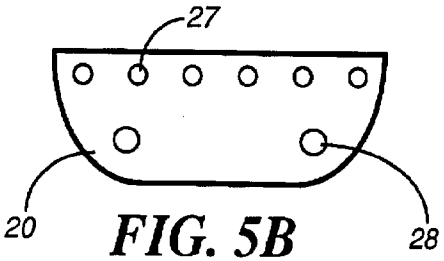
FIG. 5B is a top view of the string keeper.

FIG. 5B is a top view of the string keeper 20. The string holes 27 and the string keeper mounting holes 28 are evident.

Figure 5C:
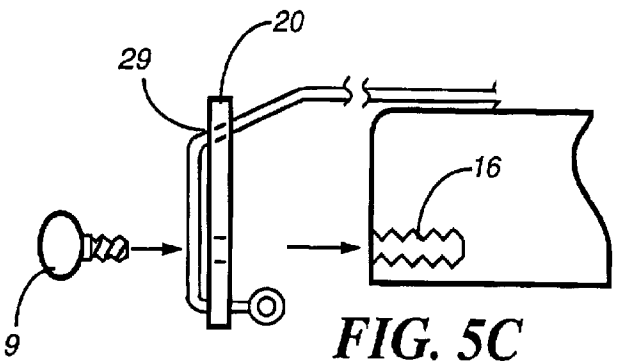
FIG. 5C illustrates an alternate design for the string keeper.
Figure 5D:
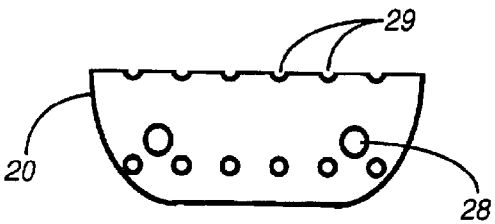
FIG. 5D shows the top view of this alternate design including the string guides.
Figure 5E:
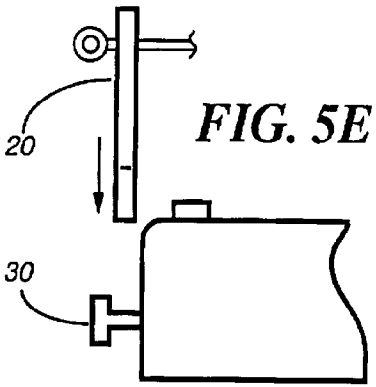
FIG. 5E illustrates an alternate design utilizing flange pins to locate and hold the string keeper in place.
Figure 5F:
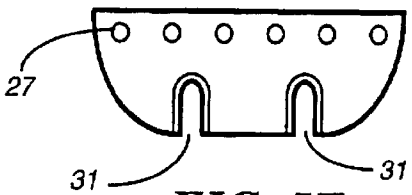
FIG. 5F is a top view of the alternate string keeper design from FIG. 5E.

FIG. 5C demonstrates an alternate design for the string keeper 20. Here the ball end of the strings 14 are engaged with string holes 27 on the bottom side of the string keeper 20. The strings 14 wrap over the string keeper 20 and pass through string guides 29. An added benefit of this design is that the extra length of string that passes over the string keeper would include the wound end of the string normally used to capture the ball end. FIG. 5D shows a top view of this design FIGS. 5E and 5F show alternate string keeper designs that alleviate the need for removable thumbscrews 19. In FIG. 5E we see a design utilizing flange pins 30 to locate and hold the string keeper 20 in place. The string keeper 20 slides into place using the flange pin slots 31. The heads of the flange pins 30 retain the string keeper 20 as the strings 14 are put under tension by tuning up the guitar using the tuning pegs 13.

FIG. 5F is a top view of this alternate string keeper 20. It shows the string holes 27 and the flange pin slots 31.

Figure 5G:
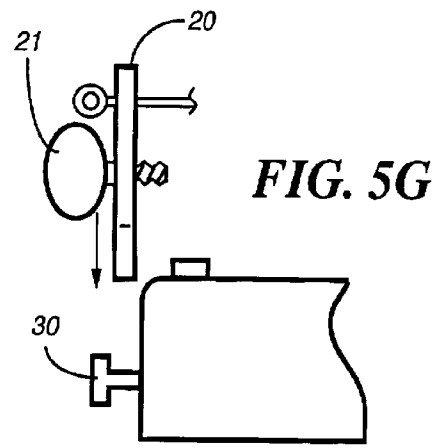
FIG. 5G illustrates yet another alternate design of the string keeper utilizing a single quick release thumbscrew.
Figure 5H:
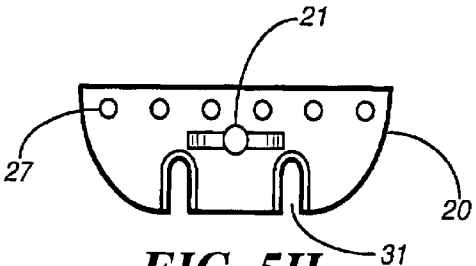
FIG. 5H shows a top view of the alternate design of the string keeper from FIG. 5G.

FIG. 5G illustrates yet another embodiment of the string keeper 20. In this instance, the string keeper 20 is held in place with flange pins 30 and is retained by a single large quick release thumbscrew 21 that serves to simultaneously tighten all strings to achieve the correct string tension in a single operation. The pins 30 keep the string keeper 20 in position. FIG. 5H shows a top view of this version of the string keeper 20. The string holes 27, the string keeper mounting holes 28 can be seen.

What is claimed is:

1. A travel guitar comprising:

a body having at least one pair of string retention flanges;

a neck that is removably attached to the body;

a plurality of strings coupled between the neck and the body; and a string keeper located at an end of the neck, the string keeper coupled to each of the plurality of strings and removably attached to the neck using a locating retainer.

2. The travel guitar according to claim 1 wherein the string keeper retains the plurality of strings and further maintains the plurality of strings in a predetermined order when the string keeper is attached to the neck.

3. The travel guitar according to claim 1 wherein the string keeper retains the plurality of strings and further maintains the plurality of strings in a predetermined order when the siring keeper is detached from the neck.

4. The travel guitar according to claim 1 wherein the plurality of strings is at least four.

5. The travel guitar according to claim 1 wherein the locating retainer comprises at least one thumbscrew.

6. The travel guitar according to claim 1 wherein the at least one pair of string retention flanges allow storage of the strings on the body when the travel guitar is disassembled.

7. The travel guitar according to claim 1 wherein the neck is coupled to the body using a simple fastening system.

8. The travel guitar according to claim 7 wherein the simple fastening system comprises at least one bolt-nut combination.

9. A travel guitar comprising:

a body having at least one pair of string retention flanges;

a neck that is removably coupled to the body; the neck having a fastening mechanism positioned at a portion of the neck that contacts the body such that the neck is removably secured to the body; and a string keeper located at an end of the neck, the string keeper coupled to each of the plurality of strings and removably attached to the neck using a locating retainer.

10. The travel guitar according to claim 9 where in the fastening mechanism between the body and the neck comprises:

at least one fastener that fixes the neck to the body by passing through the neck and the body and exerting compressive forces between adjacent surfaces of the neck and the body.

11. The travel guitar according to claim 9 wherein the string keeper retains the plurality of strings and further maintains the plurality of strings in a predetermined order when the string keeper is attached to the neck.

12. The travel guitar according to claim 9 wherein the string keeper retains the plurality of strings and further maintains the plurality of strings in a predetermined order when the string keeper is detached from the neck.

13. The travel guitar according to claim 9 wherein the plurality of strings is at least four.

14. The travel guitar according to claim 9 wherein the string keeper is removably attached to the neck using at least one thumbscrew.

15. The travel guitar according to claim 9 wherein the locating retainer comprises at least one thumbscrew.

16. The travel guitar according to claim 9 wherein the at least one pair of string retention flanges allow storage of the strings on the body when the travel guitar is disassembled.

17. The travel guitar according to claim 9 wherein the neck is coupled to the body using a simple fastening system.

18. The travel guitar according to claim 17 wherein the simple fastening system comprises at least one bolt-nut combination.

19. A travel guitar comprising:

a detachable string keeper located at an end of the neck, the detachable string keeper coupled to each of the plurality of strings, the detachable string keeper positions and retains each of the plurality of strings in a playing arrangement when the travel guitar is assembled and retains each of the plurality of strings in a compact storage arrangement using at least one pair of string retention flanges on a body when the travel guitar is disassembled.

* * * * *